United States Patent [19]

Bryce et al.

[11] 4,284,866

[45] Aug. 18, 1981

[54] MEMBRANE SWITCH ASSEMBLY

[75] Inventors: James R. Bryce, Fairport, N.Y.; Donald G. Stillie, Winston-Salem, N.C.

[73] Assignee: AMP Incorporated, Harrisburg, Pa.

[21] Appl. No.: 180,746

[22] Filed: Aug. 25, 1980

[51] Int. Cl.[3] ..... H01H 3/12; H01H 13/02

[52] U.S. Cl. ..... 200/159 B; 200/5 A; 200/292; 200/296

[58] Field of Search ..... 200/159 B, 296, 5 A, 200/292

[56] References Cited

U.S. PATENT DOCUMENTS

| | | | |
|---|---|---|---|
| 3,594,684 | 7/1971 | Miller | 200/159 B |
| 4,024,368 | 5/1977 | Shattuck | 200/5 A |
| 4,028,509 | 6/1977 | Zurcher | 200/159 B |

OTHER PUBLICATIONS

IBM Technical Disclosure Bulletin-vol. 7, No. 11, Apr. 1965, "Keyboard Encoder", by Funk et al.

*Primary Examiner*—Willis Little

*Attorney, Agent, or Firm*—Frederick W. Raring

[57] ABSTRACT

Switch assembly comprises a switch housing having a membrane switch contained therein. The switch housing has integral mounting means for mounting the assembly in an opening in a panel. The membrane switch has sheet metal switch leads extending therefrom and extending from the housing. When the assembly is mounted on a panel, these leads engage and establish electrical contact with circuit board conductors on a circuit board which is adjacent to the panel.

10 Claims, 5 Drawing Figures

MEMBRANE SWITCH ASSEMBLY

FIELD OF THE INVENTION

This invention relates to switch assemblies of a type which are intended for mounting in a panel which is adjacent to a circuit board and which are intended to control current flow through conductors on the circuit board.

BACKGROUND OF THE INVENTION

It is common practice to connect the switch conductor in membrane switches to conductors on a circuit board by providing a mult-contact connector on the membrane switch with conductors extending from the connector to a circuit board and connected to the conductors on the circuit board which are controlled by the switch. Under many circumstances, the membrane switch is mounted in a panel, for example, a housing panel, which is adjacent to the circuit board contained in the housing. The present invention is directed to the achievement of an improved switch which is intended to be readily mounted in a platelike member and which has integral switch leads which engage the circuit board conductors when the switch is mounted in the panel.

One embodiment of a switch assembly in accordance with the invention comprises a flat molded switch housing having integral means for securing the housing to a panel when the housing is inserted into an opening in the panel. The housing contains a membrane switch having resilient sheet metal conductor leads connected to, and extending from, the switch conductors contained in the switch. These leads extend obliquely away from the switch housing and have contact portions which are located and dimensioned such that when the housing is mounted in the panel, the contact portions of these leads engage the circuit board conductors on the adjacent circuit board which are to be controlled by the switch. The use of a switch in accordance with the invention, therefore avoids the necessity of providing separate connectors and cables on the switch for connecting the switch to the circuit board conductors. Furthermore, the electrical connections to the circuit board conductors are achieved by merely mounting the switch in the panel member.

DESCRIPTION OF THE DRAWINGS

FIG. 3 is a fragmentary perspective exploded view showing the circuit board, the panel, the switch housing, and the membrane switch in aligned relationship.

DESCRIPTION OF THE EMBODIMENT

Figure 2:
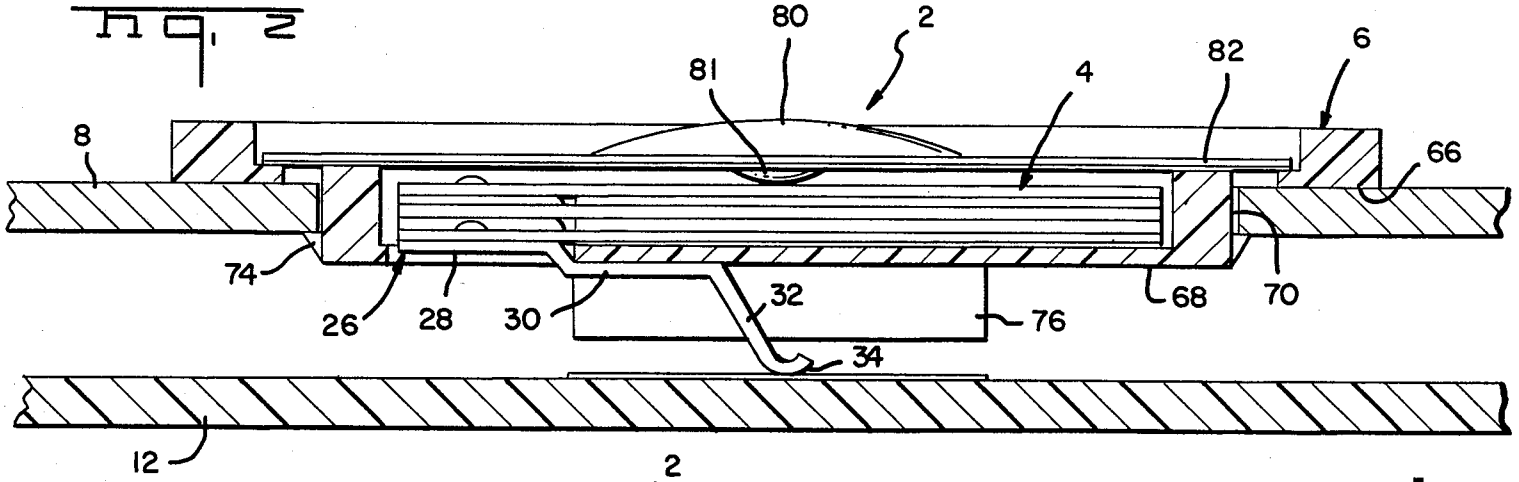
FIG. 2 is a cross-sectional view taken along the lines 2—2 of FIG. 1.

A switch assembly 2 in accordance with the invention, comprises a membrane switch 4 which is contained in a housing 6 of suitable molded insulating material, such as polyester. The assembly is mounted in an opening in a panel 8 which is adjacent to a circuit board 12 having conductors 9, 10, and 11 on the surface thereof which faces the internal surface of the panel. The switch controls the flow of current on the circuit board from the central conductor 10 to the conductors 9, 11 which are on each side of the conductor 10, as will be explained below.

The membrane switch of the disclosed embodiment is in fact, a double pole switch having three substrates in the form of insulating films 14, 16, and 18, which are in parallel spaced relationship to each other and which are separated by separator members 50, 52.

The lowermost substrate 14 has switch conductors 20 on its upwardly facing surface arranged as parallel commonly connected conductors which extend, as shown at 24, to an integral tab 22 integral with the substrate 14. A resilient sheet metal terminal 26 is connected, as by crimping or soldering, to the lead portion 24 of the switch conductors and has a first portion 28 which extends along the underside of the tab 22. An intermediate downwardly offset, as viewed in FIG. 2, portion 30 of the terminal extends along the underside of the housing and a spring arm 32 extends obliquely away from the housing. The end 34 of this arm is reversely formed to provide a bearing surface which engages one of the circuit board conductors. As will be explained below, the spring arm 32 has a length such that it is flexed to some extend when the switch is installed in the panel 8 thereby to produce a contact force urging the contact portion 34 against the circuit board conductor.

The intermediate substrate 16 has conductors 36 on its underside and conductors 38 on its upwardly facing surface, these conductors extending to a tab 40 similar to, but offset from, the tab 22. A terminal 42 is electrically connected to the end portions of the switch conductors 36, 38 and is otherwise substantially identical to the terminal 26 described above.

The substrate 18 has switch conductors 44 on its downwardly facing surface which extend to a tab 46 extending from the substrate. Again, a terminal 48, similar to the terminal 26, is electrically connected to the end portion of the switch conductor on the underside of the tab.

The separators 50, 52 have circular openings 51, 53 thereon, so that when a force is applied to the upper surface of the substrate 18, the conductors 44 will initially be brought into contact with the switch conductors 38 as central portions of the substrate 18 move relatively into opening 53. Continued application of the force to the substrate 18 causes the substrate 16 to move relatively through opening 51 so that the conductors 36 are brought into contact with the conductors 20.

The housing 6 is generally flat so that it can be fitted into an irregular opening 72 in the panel 8 and will not protrude significantly above the surface of the panel. The housing has an upper surface 56 which is recessed, as shown at 54, the central portion of this recess being sunken and conforming to the shape of the membrane switch 4. A shoulder surface 58 thus surrounds the membrane switch and a cover member 78 is bonded at 82 to this surface. The cover is advantageously of a flexible insulating material and has a convex central portion 80 which, when depressed, engages the surface of the switch to close the switch. An integral boss 81 is provided on the underside of the cover to bear against the surface of the switch.

Three openings 60, 62, and 64 are provided in the central portion of the recesses 54 and are dimensioned to receive the terminals 26, 42, and 48, as shown in FIG. 2, such that the intermediate portions 30 of the terminals bear against the downwardly facing central portion 68 of the housing. The downwardly facing side of the housing has a peripheral shoulder 66 which bears against the upper surface of the panel 8 and a vertical extending surface 70 surrounds the central portion of the housing and is shaped to conform to the non-circular shape of the opening 72. Latching or retaining means, such as ears 74, are provided on the surface 70 to retain the housing in the panel when it is inserted. The arm portions 32 of the terminals are separated by spaced-apart barriers 76 which depend from the surface 68 of the housing.

It will be apparent that the switch is assembled to the housing by merely inserting the terminals through the openings 60, 62 and 66 and thereafter bonding the peripheral portions 82 of the cover 78 to the surface portions 58 of the housing.

As previously mentioned, the length of the spring arm portions 32 of the terminals should be such that they are stressed when the switch assembly is mounted into the panel thereby to produce a contact force maintaining the contact portions 34 of the terminals against the conductors 9, 10, and 11 on the circuit board 12.

Figure 5:
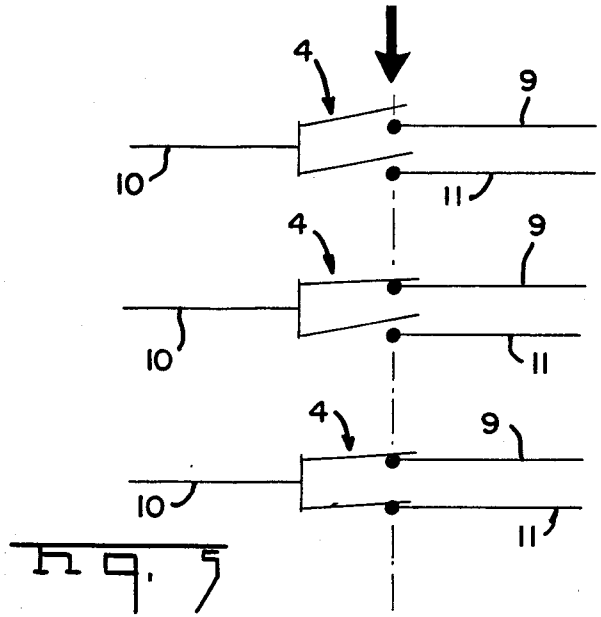
FIG. 5 illustrates the sequence of circuit closings.
Figure 1:
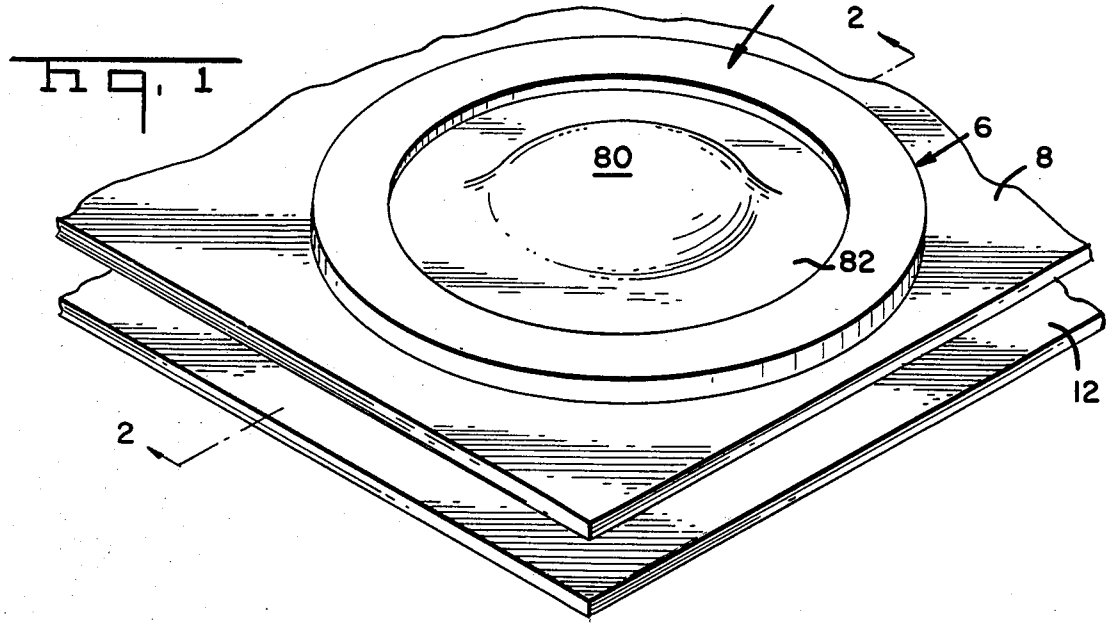
FIG. 1 is a perspective view of a switch assembly in accordance with the invention, mounted in a panel member which is adjacent to a circuit board.
Figure 7:
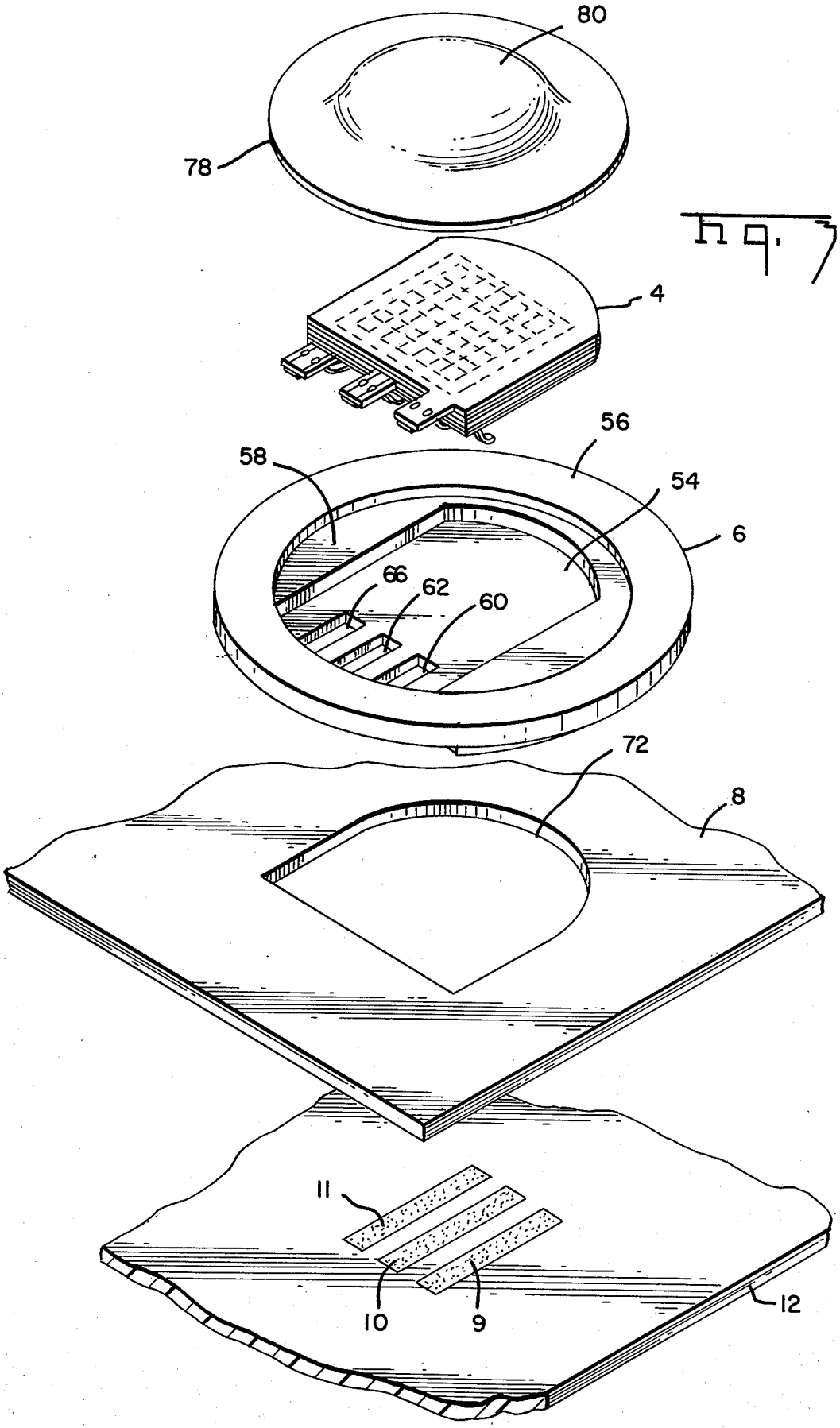
Figure 4:
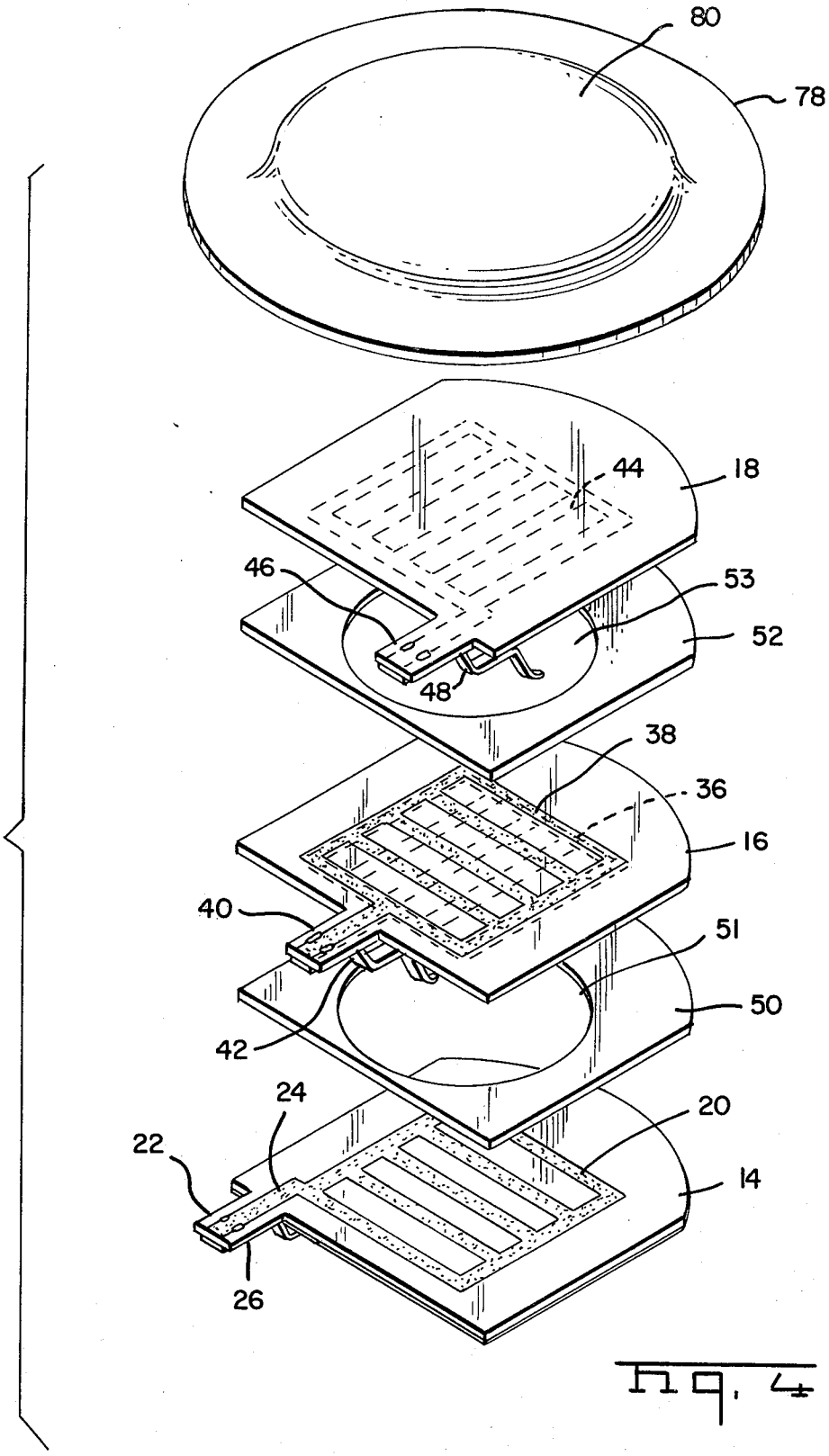
FIG. 4 is a perspective exploded view showing the parts of the membrane switch and the switch cover.

FIG. 5 illustrates the sequence of circuit closings which is achieved when the central portion 85 of the cover 78 is depressed. Initially, the conductors 44 are urged against the conductors 38 thereby closing a circuit from conductor 10 to conductor 9. Thereafter, the conductors 36 are pressed against the conductors 20 to close a circuit between the conductors 10 and 11. It will be understood that the principles of the invention can be used for switches connecting only two circuit board conductors as well as switches of the type shown.

A salient advantage of the switch assembly in accordance with the invention is that as supplied to the user, it contains the means required to establish contact with conductors on a circuit board adjacent to the panel in which the switch is mounted. Practice of the invention thus avoids the need for mult-contact connectors and cables for connecting the switch conductors to the circuit board conductors. Moreover, the assembly step of assembling the switch assembly to the panel results in achievement of the electrical connections of the switch conductors to the circuit board conductors.

While the disclosed embodiment shows only a double pole switch, it will be apparent that the principles of the invention can also be used in multi-position membrane switches of the type which have an array of switch positions. An embodiment of this type would simply require terminals as shown at 26, associated with each switch position and a single housing containing the entire switch.

We claim:

1. A switch assembly mounted in a supporting panel means and a circuit board located adjacent to, and extending parallel to said panel means, said switch assembly having a conductor leads extending therefrom and connected to circuit board conductors in said circuit board, said switch assembly and said supporting panel means being characterized in that:

said switch assembly comprises a membrane switch and switch supporting means, said membrane switch being supported in said panel means by said switch supporting means, said membrane switch comprising a pair of flexible insulating substrates having opposed surfaces, switch conductors on said opposed surfaces and separator means between said opposed surfaces normally maintaining said opposed surfaces in spaced-apart relationship, said separator means permitting relative flexing movement of said substrates normally of their own planes towards each other thereby to move said switch conductors into contact with each other, said conductor leads comprising resilient sheet metal conductors connected to said switch conductors and extending from said switch assembly towards said circuit board, said conductor leads having contact portions bearing against, and in electrical contact with, said circuit board conductors.

2. An assembly as set forth in claim 1, said switch supporting means comprising a switch housing, said switch housing being in said panel means, said membrane switch being contained in said switch housing.

3. An assembly as set forth in claim 2, said panel means having an opening therein, said switch housing comprising a separate part mounted in said opening.

4. An assembly as set forth in claim 3, said switch housing comprising a flat molded member having a central recess therein, said membrane switch being in said recess, said recess having a floor having openings therein, said conductor leads extending through said openings.

5. An assembly as set forth in either of claims 3 or 4, said conductor leads extending obliquely from said switch housing to said circuit board, said housing being secured to said panel means and maintaining said conductor leads in a flexed condition thereby to maintain contact force in said conductor leads at said contact portions.

6. An assembly as set forth in claim 5, said housing having a cover thereon in covering relationship to said membrane switch, said cover being inwardly flexible towards said membrane switch to permit closing of said switch.

7. A membrane switch assembly which is intended for mounting in a panel for electrical connection to circuit board conductors on a circuit board which is adjacent to, and spaced from, said panel, said membrane switch assembly comprising:

a membrane switch and a switch housing, said membrane switch comprising a pair of flexible insulating substrates having opposed surfaces, switch conductors on said opposed surfaces and separator means between said opposed surfaces normally maintaining said opposed surfaces in spaced-apart relationship, said separator means permitting relative flexing movement of said substrates normally of their own planes towards each other thereby to move said switch conductors into contact with each other, said switch housing being generally flat and having a recess extending into one surface thereof, said membrane switch being in said recess, switch conductor leads connected to said switch conductors, said switch conductor leads comprising sheet metal members extending from said membrane switch and through said housing and beyond the other surface of said housing, said switch conductor leads having free ends and having contact portions on said free ends whereby, upon mounting said membrane switch assembly in an opening in said panel with said other surface of said housing opposed to said circuit board, said contact portions of said leads will bear against said circuit board conductors and said switch will control current flow through said circuit board conductors.

8. A membrane switch assembly as set forth in claim 7, said housng having integral mounting means for mounting said switch assembly in said opening in said panel.

9. A membrane switch assembly as set forth in claim 8, said housing having a cover thereon in covering relationship to said membrane switch, said cover having central portions which overlie said switch and which are movable towards said membrane switch to close said switch.

10. A membrane switch assembly as set forth in claim 9, said cover comprising a flexible insulating film bonded to said housing.

* * * * *